United States Patent [19]

Williams

[11] 4,161,305

[45] Jul. 17, 1979

[54] TILT CHAIR CONTROL MECHANISM

[75] Inventor: Philip J. Williams, Poland, Ohio

[73] Assignee: GF Business Equipment, Inc., Youngstown, Ohio

[21] Appl. No.: 866,166

[22] Filed: Dec. 29, 1977

[51] Int. Cl.[2] ..... A45D 19/04

[52] U.S. Cl. ..... 248/608

[58] Field of Search ..... 248/373, 374; 297/303, 297/304, 326, 327

[56] References Cited

U.S. PATENT DOCUMENTS

| | | | |
|---|---|---|---|
| 2,008,209 | 7/1935 | Herold | 248/374 |
| 3,552,796 | 1/1971 | Williams | 248/373 X |
| 3,592,433 | 7/1971 | Fuhrman | 248/373 |
| 3,598,354 | 8/1971 | Williams | 248/373 |

*Primary Examiner*—James C. Mitchell

*Attorney, Agent, or Firm*—Emory L. Groff, Jr.

[57] ABSTRACT

A control mechanism for a tilt seat chair includes a control body supported in a relatively stationary position by a fixedly attached vertical post member. A torsion unit comprising a pair of resiliently urged concentric sleeves extends through opposed sidewalls of the control body forwardly of the post member and includes a forwardly extending tension lever having adjusting means constantly bearing against a case hardened transverse plate carried by the control body. A chair seat spider assembly pivotedly supported solely by the innermost sleeve of the torsion unit normally abuts, in its at-rest-position, nonmetallic forward stop means carried by the control body and is limited in rearward tilting displacement by abutment of the same spider assembly with rear stop ramps comprising integral portions of the control body disposed rearwardly of the vertical post member.

7 Claims, 6 Drawing Figures

TILT CHAIR CONTROL MECHANISM

This invention relates generally to a chair control device and more particularly to an improved mechanism permitting of tiltable displacement of a chair seat while allowing of selective regulation of the force resisting such tilting of the chair seat.

The adjustable regulation of the resistant force applicable to the subject control mechanism is provided by a tilt torsion unit of the type employing a pair of concentrically disposed sleeeves secured to one another by means of an intermediate layer of a suitable resilient composition such as synthetic rubber and wherein the two sleeves are respectively attached to a movable chair seat and a relatively stationary component of the chair. The broad concept of such tilt control means is generally well known and an exemplary torsion unit will be found in U.S. Pat. No. 3,881,772, issued May 6, 1975, to Mohrman. By the present arrangement, an improved structure is provided employing fewer components, which is more economical to manufacture and which results in superior operating characteristics heretofore unavailable.

The control mechanism of the instant invention includes a torsion unit, the outer sleeve of which is stationary with respect to a control body during tilting displacement of the chair seat and wherein an improved silent operation of the present device is achieved by including non-metallic means interposed between those components which are relatively displaceable during adjustment of the tension of the torsion unit and also between those components serving as the stop means limiting the forward tilt or defining the at-rest position of the chair seat. Additionally, improved simplified means are incorporated in the control body itself to limit the rearward tilting displacement of the chair seat.

Accordingly, one of the objects of the present invention is to provide an improved chair control mechanism including a tilt torsion unit carried by a spider assembly affixed to the chair seat and journaled within a relatively stationary control body.

Another object of the present invention is to provide an improved chair control mechanism including a relatively stationary control body having a fixed front stop member, including non-metallic bumper means limiting the forward displacment of a chair seat spider assembly and including integral rear stop ramps forming rearward tilt limit means for the spider assembly.

A further object of the present invention is to provide an improved chair seat control mechanism including a relatively stationary control body having a torsion unit journaled therein including a tension lever having adjustment means engageable with a case hardened plate affixed to the control body which control body is isolated from the torsion unit by non-metallic bushings preventing annoying noises during backward motion of the chair seat.

With these and other objects in view which will more readily appear as the nature of the invention is better understood, the invention consists in the novel construction, combination and arrangement of parts hereinafter more fully described, and illustrated and claimed.

Similar reference characters designate corresponding parts throughout the several views of the drawings.

Figure 1:
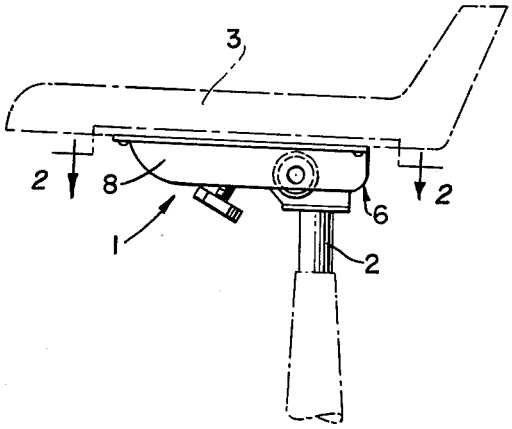
FIG. 1 is a side elevation of the control mechanism of the present invention.

Referring now to the drawings, particularly FIG. 1, the present invention will be seen to include a tilt control mechanism, generally designated 1, including a vertical post or collar 2 which is adapted to be secured in a relatively statinary manner to any suitable well known chair base structure. Such stationary attachment will be understood not to exclude the use of any conventional swivel or height adjustment mechanisms in the base structure and only refers to the vertical stability of the collar 2 during tilting of the seat 3. The control mechanism 1 is intended to permit limited spring-resisted rearward tilting of a chair seat 3 which is affixed, such as by the attaching means 4, to a spider assembly comprising a right hand spider arm 5 and left hand spider arm 6. Each spider arm includes a planar top wall 7 having a side flange 8 depending from its outer edge.

Figure 4:
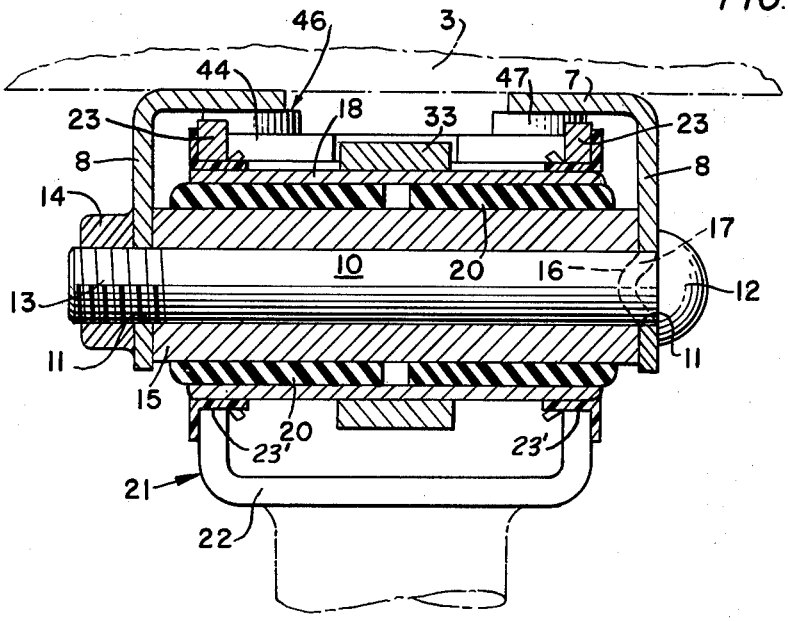
FIG. 4 is an enlarged transverse vertical sectional view taken along the line 4—4 of FIG. 3.

The sole attachment of the spider assembly and thus the chair seat 3 to the balance of the control mechanism is by means of a torsion unit, generally designated 9, which, as will be seen most clearly in FIG. 4, is mounted between the depending spaced apart side flanges 8 of the two spider arms 5 and 6.

The tilt torsion unit 9 includes a central axle or bolt 10 disposed through opposite holes 11—11 formed in the spaced apart spider arm side flanges 8 and is provided with a head 12 at one end and a threaded portion 13 at the other end, the latter of which cooperates with a nut 14 to retain the axle 10 in the position as shown in the drawings. Surrounding the axle 10 and traversing the distance between the opposed spider arm side flanges 8 is an inner sleeve 15 forming a close fit with the axle 10 and which is permanently keyed to the spider arm side flanges 8 by any suitable means such as the plurality of detents 16—16 formed in the sleeve ends and within which are disposed the mating lugs 17—17 struck inwardly from the spider arm side flanges 8 in the area immediately surrounding the holes 11 therethrough. With the foregoing arrangement it will thus be seen that any tilting displacement of the chair seat 3 and its attached spider assembly will result in a corresponding angular displacement of the torsion unit inner sleeve 15.

Additional components of the torsion unit 9 include the outer sleeve 18 concentrically disposed about the inner sleeve 15 and spaced therefrom to receive the intermediate resilient elements 20 comprising any suitable well known elastomeric composition having its opposed surfaces respectively suitably bonded to the outer periphery of the inner sleeve 15 and press-fitted within the inner periphery of the outer sleeve 18 whereupon a resistant or yieldable connection is provided between the two concentric sleeves. The length of the outer sleeve 18 is noticeably shorter than that of the inner sleeve 15 for reasons which will become obvious hereinafter.

The above described structure comprising the chair seat, spider assembly and supported torsion unit are all supported atop the post collar 2 by means of the control body 21 comprising a U-shaped channel member having a bottom wall 22 securely affixed to the top of the post collar 2 and a pair of upwardly extending spaced apart side walls 23—23. The attachment of the post collar to the bottom wall 22 of the control body is quite important in view of the relatively stationary disposition of the post collar 2 and the fact that all of the forces imposed during the use of the chair and tilting of its seat 3 will be transmitted through the side walls 23 of the control body to the upper portion of the collar 2. Accordingly, an improved rigid connection has been devised comprising the upwardly extending reduced diameter portion 24 projecting through the opening 25 of the control body bottom wall 22 whereby an upwardly facing shoulder 26 is formed on the collar 2 in direct abutment with the undersurface of the control body bottom wall 22. That portion of the reduced diameter portion 24 extending above the plane of the control body bottom wall 22 is swaged or staked as at 27 to provide a rigid attachment between the two components and in order to provide additional insurance against any relative displacement of the two members a continuous weld 28 is provided between the adjacent components beneath the control body bottom wall 22 as shown in FIGS. 3 and 4 of the drawings.

Figure 3:
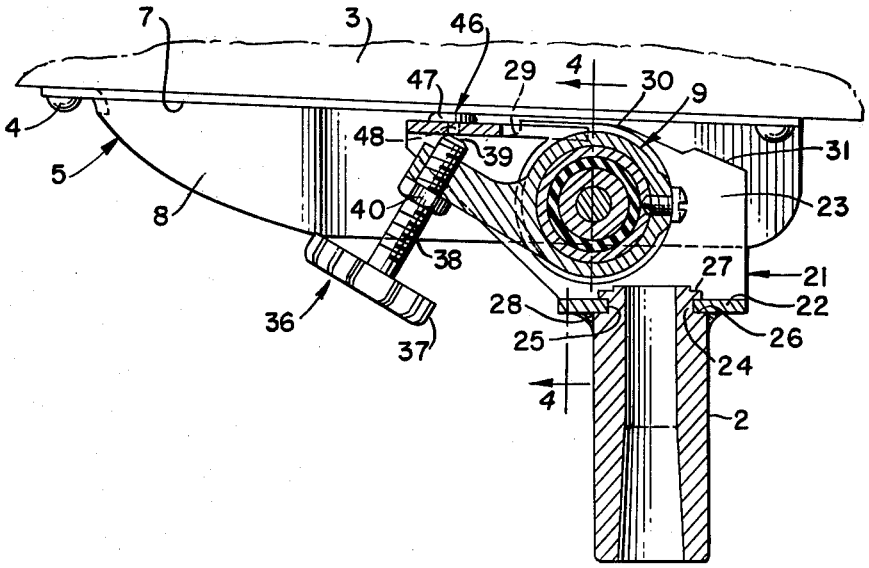
FIG. 3 is a longitudinal vertical sectional view taken along the line 3—3 of FIG. 2.

As shown most clearly in FIG. 3 of the drawings, the integral construction of the control body 21 includes side walls 23 having a particular upper configuration including a recessed side wall top 29 disposed well forwardly of the torsion unit 9 and extending to the forwardmost end of the side walls 23. The center portion 30 of the side wall top represents the highest point of the two side walls 23—23 and extends rearwardly from the recessed portion 29 to a point above the center axis of the torsion unit axle 10 and from this point rearwardly the top of each of the side walls will be seen to be inclined downwardly terminating in a raised rear stop ramp 31 the purpose of which will be described hereinafter.

The torsion unit and its attached spider arms and chair seat are joined to the relatively immobile control body 21 by the disposition of the torsion unit 9 through close-fitting holes 23'—23' in the side walls 23. As shown in FIG. 4 both side walls 23—23 and the distal portions of the outer sleeve 18 are spaced well inwardly from the outermost spider arm flanges 8 to preclude interference therebetween during relative angular displacement.

The resistant force applied by the torsion unit 9 when a user of the chair tilts the seat rearwardly is provided and regulated by means of a tension lever 32 comprising a unitary member of a width substantially less than the length of the torsion unit inner and outer sleeves 15 and 18 respectively and which includes a collar 33 surrounding the medial portion of the torsion unit outer sleeve 18 and a forwardly extending tension lever arm 34.

Throughout the operation of the instant device it will be understood that the tension lever 32 is angularly fixed relative to the torsion unit outer sleeve 18 and this may be achieved by means of a suitable anchor member 35 comprising a screw passing through the tension lever collar 33 and into an opening in the torsion unit outer sleeve 18. The forwardmost portion of the tension lever arm 34 includes a tension regulating means, generally designated 36, comprising an adjusting wheel 37 affixed to a threaded adjusting screw 38 which in turn is threaded through the tension lever arm 34 and includes a distal contact nose 39. Suitable means may be included such as the lock nut 40 to securely retain the tension regulating means 36 in its selected adjustment relative to the tension lever 32.

The tension regulating means 36 is intended to serve two purposes. First, the contact nose 39 thereof abuts a stationary member during rearward tilting of the chair seat 3 to angularly immobilize the tension lever 32 and thereby the outer sleeve 18 of the torsion unit 9 so that the angular displacement of the inner sleeve 15 caused by tilting of the spider arm side flanges 8 affixed thereto will meet with a resistant force due to the elastomeric connection between the torsion unit sleeves 15 and 18 and secondly, the tension regulating means 36 provides ready means whereby the relative angular disposition of the tension lever arm 34 with respect to the stationary control body 21 may be selectively altered with the chair seat 3 in its at-rest position so as to vary the relative angular disposition between the torsion unit inner and outer sleeves to thereby modify the degree of torque being offered by the resilient elements 20.

Figure 2:
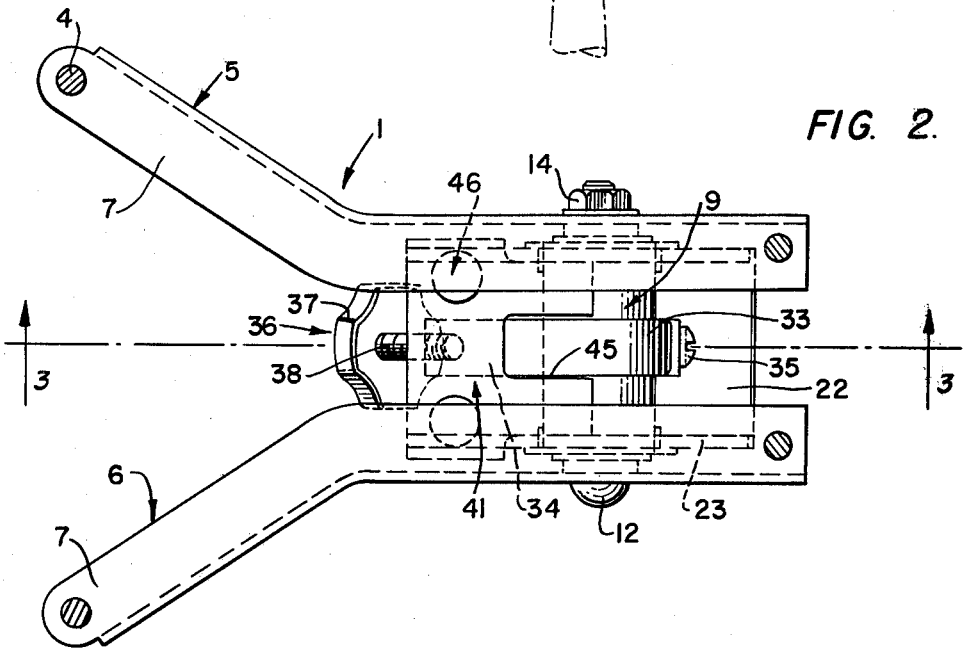
FIG. 2 is an enlarged top plan view of the central mechanism of FIG. 1.

The foregoing action of the tension regulating means 36 is brought about due to the abutment of the contact nose 39 with a front stop member, generally designated 41, comprising a case hardened element rigidly affixed to the upper portion of the control body 21. The front stop member 41 includes a transverse plate 42 having a pair of laterally projecting flanges 43—43 overlying the top portion of the control body side walls 23—23 within the recessed portions 29—29 thereof. The entire front stop member 41 is permanently affixed to the control body 21 such as by welding thereto (not shown). Projecting rearwardly from the transvese plate 42 are a pair of rear projecting arms 44—44 defining a central notch 45 therebetween within which is disposed the upper portion of the tension lever collar 33 as shown most clearly in FIGS. 2 and 5 of the drawings. The formation of the entire front stop member 41 of case hardened material has been found to be a decided advantage in association with the steel composition of the remaining metallic components of the present invention since experience has shown that a galling action has occurred between the contact nose and abutment means in the case of previous tension adjusting mechanisms and the present utilization of a case hardened abutment member precludes this objectionable feature.

Positive retention of the lateral alignment between the torsion unit 9 and control body is assured at all times, even during tilting of the chair seat and spider assembly, due to the relative disposition of the above described tension lever collar 33 and front stop member 41. It will be noted that a substantial portion of the collar 33 is at all times captivated between the rear projecting arms 44—44, forming a close fit within the notch 45.

Figure 5:
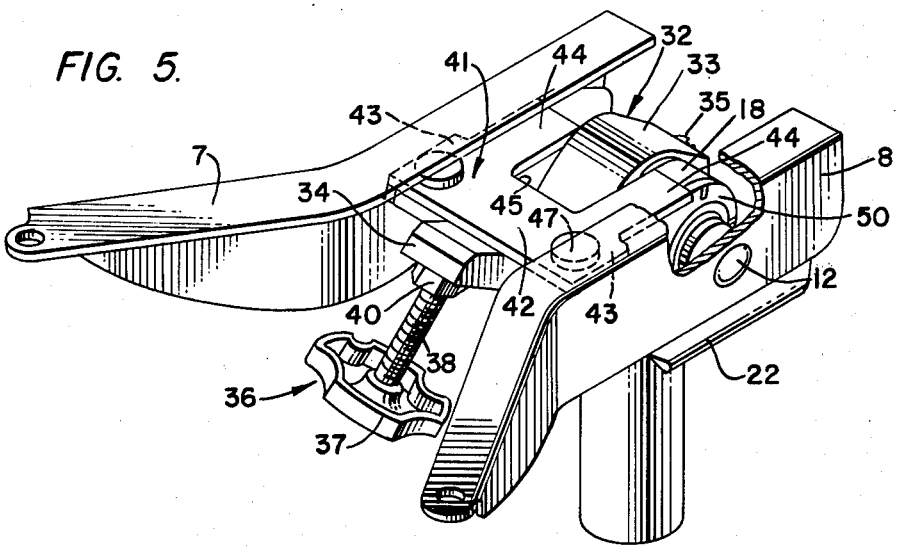
FIG. 5 is a top perspective view, with portions broken away, of the structure shown in FIG. 2.

In many prior installations the forwardmost limit of travel of a tiltable chair seat has been regulated by means of metal to metal contact, the disadvantages of which should be readily apparent and accordingly the present invention includes means in the form of non-metallic bumpers 46—46 carried by the front stop member 41 and serving as abutment means for the chair seat spider assembly as shown most clearly in FIGS. 3-5 of the drawings. Each non-metallic bumper 46 includes an enlarged cap 47 disposed above the plane of the top of the stop member transverse plate 42 adjacent the lateral edges thereof and from which depends a stem 48 disposed through holes in the stop member 41 for retaining the caps 47 in the use position as illustrated, so that when the chair assembly is in its at-rest or forwardmost position the undersurface of the spider arm top walls 7—7 will abut the top surface of the non-metallic bumper caps 47.

Figure 6:
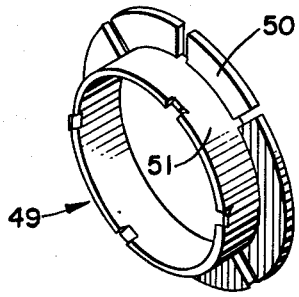
FIG. 6 is a perspective view of a split plastic bushing employed in the torsion unit of the present invention.

Although the present structure avoids relative angular displacement between the torsion unit outer sleeve 18 and the control body side walls 23 during tilting action of the chair seat 3, the fact that the outer sleeve is journaled within the control body side walls could encourage galling action between the two components and result in an annoying squeal and accordingly it is proposed to include a synthetic split bushing, generally designated 49, disposed therebetween as shown most clearly in FIG. 4 of the drawings. This bushing itself is illustrated in FIG. 6 wherein it will be seen to include an outer vertical flange 50 integral with the horizontally disposed collar 51 the former of which abuts the outer surface of the control body side walls 23 while the latter isolates the openings in the control body side walls from the outer periphery of the torsion unit outer sleeve 18.

By the provision of the downwardly inclined ramps 31 on the control body side walls 23, integral means are formed to limit the rearward tilting action of the chair seat and spider assembly. The tilt angle will be determined by the relative angle between the plane of the front stop member 41 and the ramps 31 and a typical relative angle is 20°.

We claim:

1. A control mechanism for a chair having a tiltable seat including, a relatively stationary control body having a pair of vertical spaced-apart side walls, a torsion unit provided with an outer sleeve having end portions journaled within openings in said side walls, said outer sleeve end portions normally angularly stationary relative to said control body side walls during tiltable displacement of said seat, an inner sleeve within said outer sleeve and joined thereto by an intermediate resilient element to provide a relative angular biasing action between said two sleeves, a spider assembly attached to said chair seat including a pair of depending side flanges respectively overlying the ends of said torsion unit inner sleeve, means locking said spider side flanges to said inner sleeve to preclude relative angular displacement therebetween, a tension lever having a collar surrounding said outer sleeve and a forwardly projecting arm constantly biased upwardly toward said seat, means locking said collar to said outer sleeve, a disparate front stop member spanning and fixedly secured to the top forward portion of said control body side walls, said front stop member of case-hardened steel, adjustable tension regulating means carried by the distal portion of said tension lever arm and engageable with the undersurface of said front stop member whereby adjustment of said tension regulating means produces relative frictional motion between said regulating means and said front stop member, said case-hardened steel front stop member including a transverse plate engageable by said tension regulating means and a pair of rearwardly projecting arms each extending from said plate to a point overlying said outer sleeve, said arms spaced apart to define a central notch therebetween, at least a portion of said arms straddling the lateral limits of said tension lever collar, limit means on the upper surface of said front stop member abutting said spider assembly to define the forward tilt limit of said chair seat, and inclined stop ramps on the top of said control body side walls disposed rearwardly of said torsion unit and abutted by said spider assembly when tilted rearwardly.

2. A control mechanism according to claim 1 wherein, said spider assembly includes a pair of spaced apart spider arms each provided with a horizontal top wall attached to said side flanges, at least a portion of each said top wall overlying said control body side walls and said limit means includes bumpers engaging said spider arm top walls.

3. A control mechanism according to claim 1 including, a post collar depending from said control body, a bottom wall joining said side walls, a reduced diameter portion on the top of said post collar extending upwardly through an opening in said bottom wall, means securing said collar to the undersurface of said bottom wall and deformed means on said reduced diameter portion securing said collar adjacent the uppersurface of said bottom wall.

4. A control mechanism according to claim 1 wherein, said control body side walls are spaced inwardly from said spider assembly side flanges and a non-metallic bushing is disposed between said outer sleeve and each said control body side wall opening.

5. A control mechanism according to claim 2 wherein, said bumpers are non-metallic and each includes a cap having a depending stem inserted through an opening in said front stop member.

6. A control mechanism according to claim 3 wherein, the center axis of said torsion unit is disposed forward of the vertical axis of said post collar.

7. A control mechanism according to claim 3 wherein, said stop ramps are disposed rearwardly of the vertical axis of said post collar.

* * * * *